US006176488B1

(12) United States Patent
Kao

(10) Patent No.: US 6,176,488 B1
(45) Date of Patent: Jan. 23, 2001

(54) GAME DEVICE

(76) Inventor: Fang-Hsiung Kao, No. 44, Lane 166, Ta-Hu Street, Nei-Hu Dist., Taipei City (TW)

( * ) Notice: Under 35 U.S.C. 154(b), the term of this patent shall be extended for 0 days.

(21) Appl. No.: 09/348,913

(22) Filed: Jul. 7, 1999

(51) Int. Cl.[7] ..... A63F 3/06

(52) U.S. Cl. ..... 273/270; 273/287; 273/269; 273/282.1

(58) Field of Search ..... 273/281, 282.1, 273/282.2, 273, 287, 269, 270; 434/198, 199

(56) References Cited

U.S. PATENT DOCUMENTS 2,391,520 * 12/1945 Smith .
2,634,131 * 4/1953 Buchmiller .
2,784,972 * 3/1957 Mater .
3,383,112 * 5/1968 Crozier .
3,596,912 * 8/1971 Herring .
3,851,882 * 12/1974 Steinle .
4,026,052 * 5/1977 Ando .
4,322,904 * 4/1982 Muderlak .

* cited by examiner

*Primary Examiner*—Jeanette Chapman
*Assistant Examiner*—Vishu Mendiratta
(74) *Attorney, Agent, or Firm*—Baker Botts L.L.P.

(57) ABSTRACT

A game device includes an upper board, a lower mounting board and a plurality of displaying members. The upper board includes a plurality of upper rows and columns of displaying areas which define respectively displaying openings, and a plurality of upper rows and columns of shielded areas disposed angularly adjacent to the displaying openings to constitute an array of displaying openings and shielded areas. The lower mounting board is superimposed by the upper board in a transverse direction, and defines a plurality of lower rows and columns of leading swept areas registered with the displaying openings, and a plurality of lower rows and columns of tailing swept areas angularly adjacent to the leading swept areas, and registered with the shielded areas to constitute an array of leading and tailing swept areas. Each displaying member includes an upper major wall with a specific print thereon, and is disposed detachably and swiveledly on the lower mounting board such that the upper major wall is turnable about a swivel axis between a respective leading swept area to expose the specific print to one of the displaying openings, and a respective tailing swept area to hide the specific print under one of the shielded areas.

8 Claims, 6 Drawing Sheets

GAME DEVICE

BACKGROUND OF THE INVENTION

1. Field of the Invention

This invention relates to a game device, more particularly to a game device with displaying members mounted detachably and swiveledly to a lower mounting board and exposed to or hidden under an upper board superimposed upon the lower mounting board.

2. Description of the Related Art

Bingo is a game played and appreciated by young and old alike. Each of the participants of a bingo game is given a bingo card provided with a unique set of numbers. When a number is drawn randomly from a bag and is called out by the caller, the participants compete by covering the corresponding numbers with tokens in the given card. The first participant to achieve a predetermined arrangement of tokens on the bingo card becomes the winner of the game.

Another way of playing a game of bingo is to use a bingo game box with rows and columns of openings for insertion of game blocks with predetermined printed matter thereon. However, there is no means for fastening the game blocks on the game box, thereby resulting in undesired removal of the game blocks when they are not inserted into the openings.

SUMMARY OF THE INVENTION

The object of the present invention is to provide a game device in which a plurality of displaying members with specific print thereon are mounted detachably and swiveledly to a lower mounting board so as to be turnable for expose from or hiding under an upper board that is superimposed upon the lower mounting board. As such, the displaying members may be retained between the lower mounting board and the upper board to preventing misplacing of the same.

According to this invention, the game device includes an upper board, a lower mounting board and a plurality of displaying members. The upper board includes a plurality of upper rows of first displaying areas which respectively define first displaying openings, a plurality of upper rows of first shielded areas, each of which is disposed angularly adjacent to a respective first displaying opening, a plurality of upper columns of second displaying areas which respectively define second displaying openings, and a plurality of upper columns of second shielded areas, each of which is disposed to be angularly displaced and adjacent to a respective second displaying opening. Each first displaying opening and each first shielded area are substantially and respectively identical to each second displaying opening and each second shielded area such that the upper rows and the upper columns constitute an array of displaying openings and shielded areas. The lower mounting board is disposed to be spaced apart from, and is superimposed upon the upper board in a transverse direction. The lower mounting board defines a plurality of lower rows of first leading swept areas which are registered respectively with the upper rows of the first displaying openings in the transverse direction, a plurality of lower rows of first tailing swept areas each of which is disposed angularly adjacent to a respective first leading swept area, and each of which is registered with a respective first shielded area, a plurality of lower columns of second leading swept areas, and a plurality of lower columns of second tailing swept areas each of which is disposed to be angularly displaced and adjacent to a respective second leading swept area. Each first leading area and each first tailing swept area are substantially and respectively identical to each second leading area and each second tailing swept area, such that the lower rows and the lower columns constitute an array of leading and tailing swept areas. Each displaying member includes an upper major wall with a specific print thereon, and is interposed between a respective shielded area and the tailing swept area. Each displaying member is disposed detachably and swiveledly on the lower mounting board and proximate to the tailing swept area, such that the upper major wall is turnable about a swivel axis parallel to the transverse direction between the leading swept area, where the specific print is exposed to a respective displaying opening, and the respective tailing swept area, where the specific print is hidden under the respective shielded area.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
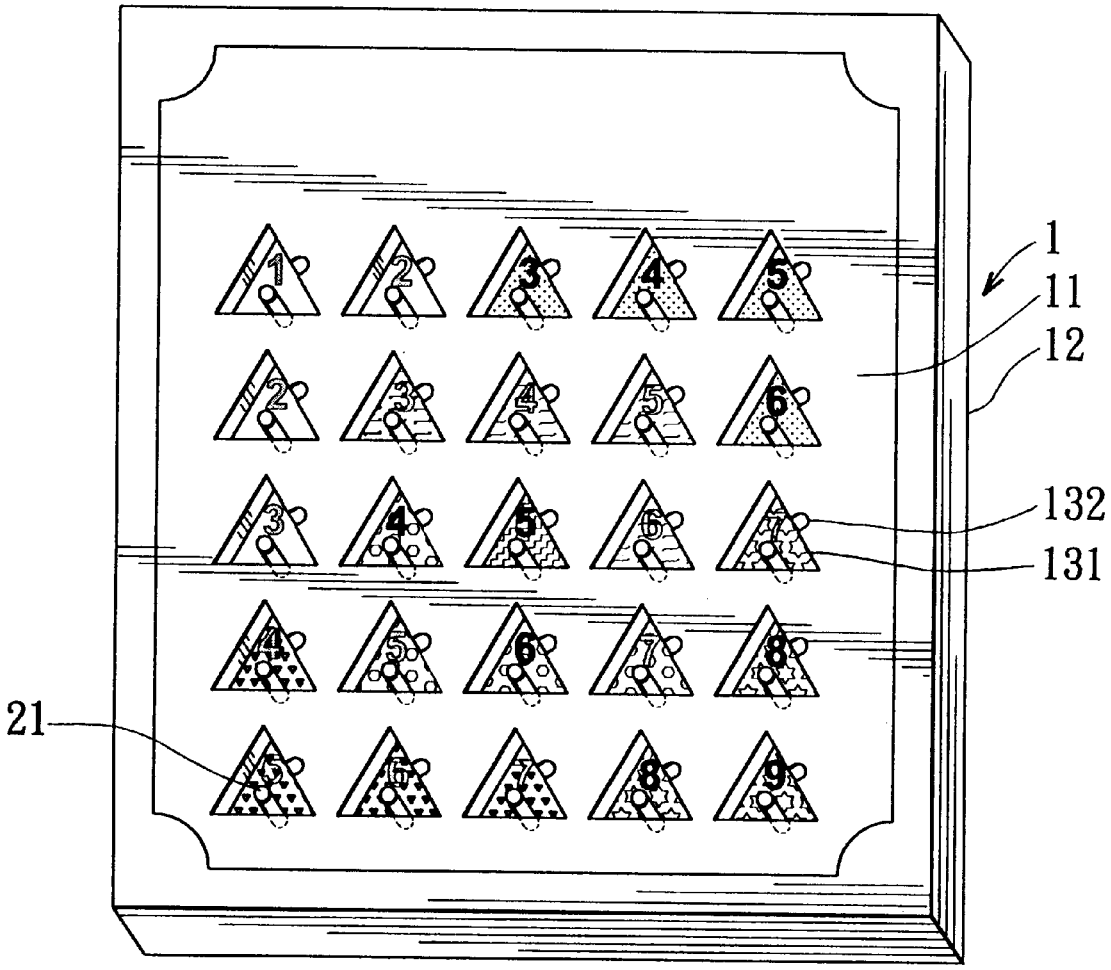
FIG. 1 is a perspective schematic view of a preferred embodiment of a game device according to this invention.
Figure 2:
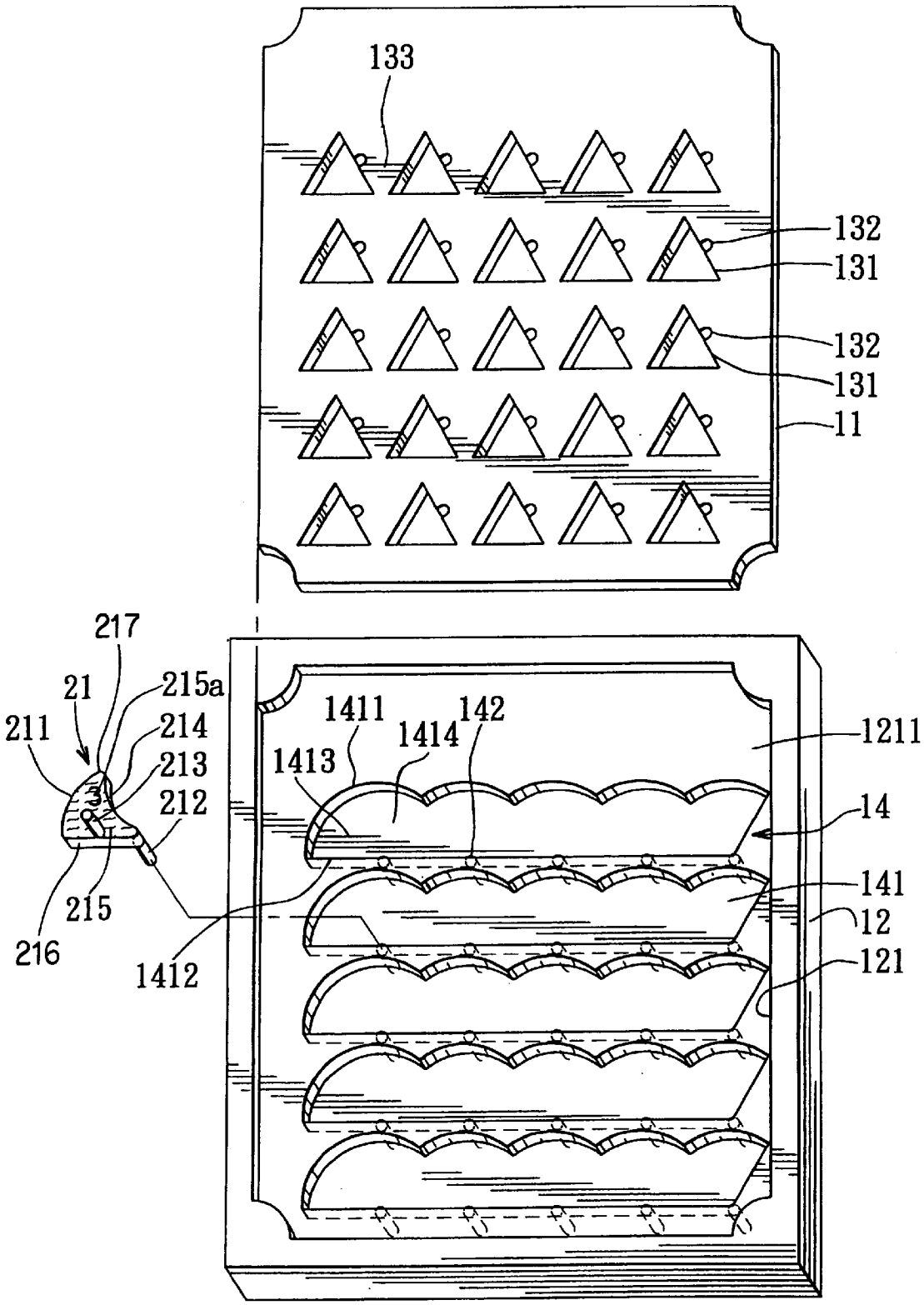
FIG. 2 is an exploded view of the preferred embodiment.
Figure 3:
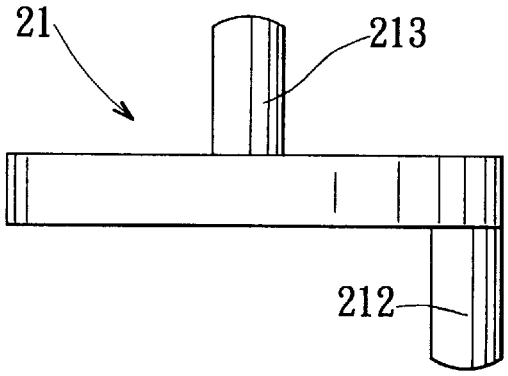
FIG. 3 is a side view showing a displaying member of the preferred embodiment.

Referring to FIGS. 1, 2 and 3, the preferred embodiment of the game device 1 according to the present invention is shown to comprise an upper board 11, a lower mounting board 12, and a plurality of displaying members 21 of different colors.

Referring to FIG. 2, the upper board 11 includes five upper rows of first displaying areas which respectively define first displaying openings 131 of triangular shape, five upper rows of first shielded areas 133, each of which is disposed angularly adjacent to the respective first displaying opening 131, five upper columns of second displaying areas which respectively define second displaying openings 131, and five upper columns of second shielded areas 133, each of which is disposed to be angularly displaced and adjacent to the respective second displaying opening 131. Each first displaying opening 131 and each shielded area 133 are identical to each second displaying opening 131 and each shielded area 133 such that the upper rows and the upper columns constitute an array of displaying openings 131 and shielded areas 133. In addition, the upper board 11 further has a plurality of engaging holes 132, each of which is disposed between a respective displaying opening 131 and a respective shielded area 133.

The lower mounting board 12 has an engaging concavity 121 for receiving the upper board 11. The upper board 11 is disposed to be spaced apart from and is superimposed upon the lower mounting board 12 in a lower portion 1211 of the concavity 121 in a transverse direction. The lower portion 1211 has five rows of groove units 14 which extend in the transverse direction. Each groove unit 14 includes five grooves 141 which are communicated with one another. Each groove 141 is confined by a barrier wall portion (radial edge) 1412 and a guiding wall portion (surrounding edge) 1411 to form a lower row of a first leading swept area 1413 which is registered with a respective one of the upper rows of the first displaying openings 131 in the transverse direction, and a lower row of a first tailing swept area 1414 which is disposed angularly adjacent to a respective first leading swept area 1413, and which is registered with a respective one of the first shielded areas 133. On the other hand, the lower portion 1211 has five columns of groove units 14, each of which includes five grooves 141. Each groove 141 has a lower column of a second leading swept area 1413, and a lower column of a second tailing swept area 1414 which is disposed to be angularly displaced and adjacent to a respective second leading swept area 1413. Each first leading swept area 1413 and each first tailing swept area 1414 are substantially and respectively identical to each second leading area 1413 and each second tailing swept area 1414 such that the lower rows and the lower columns constitute an array of leading and tailing swept areas 1413,1414. Moreover, the lower portion 1211 further defines a plurality of swivel holes 142, each of which is formed in the barrier wall portion 1412 and distal to the guiding wall portion 1411 and each of which extends in the transverse direction.

Figure 4:
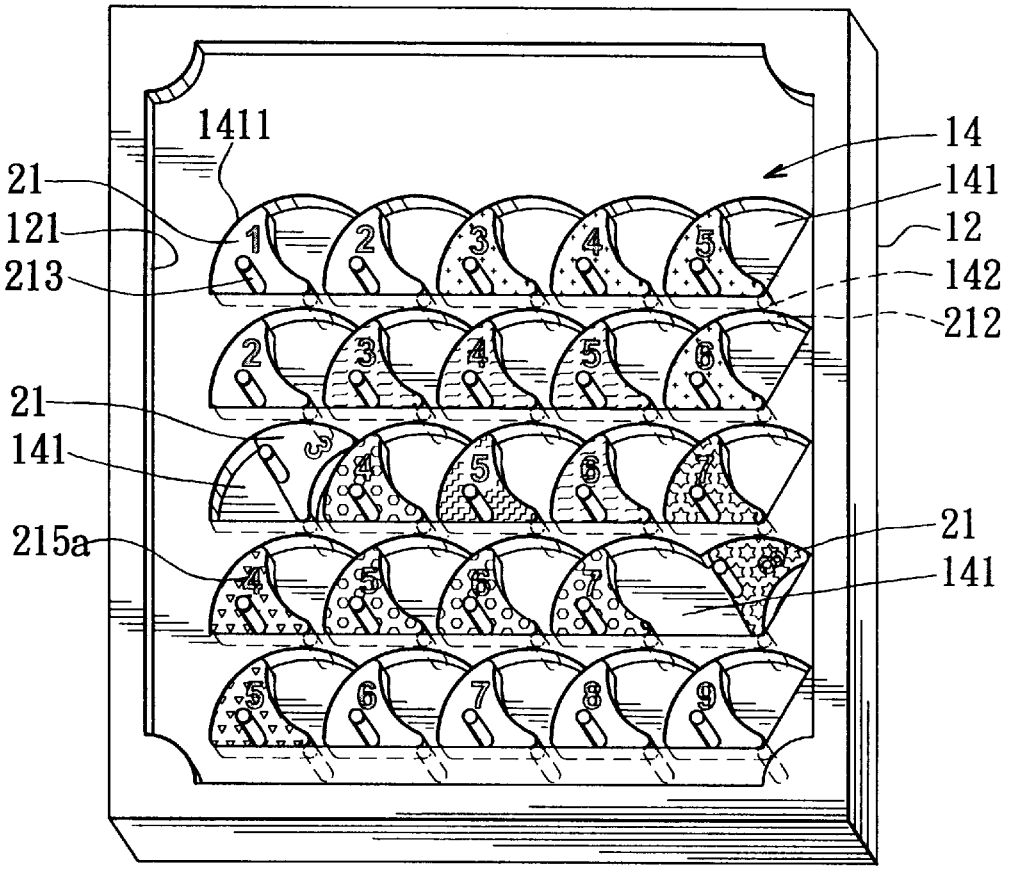
FIG. 4 is a perspective schematic view of the preferred embodiment, wherein an upper board thereof is removed.
Figure 5:
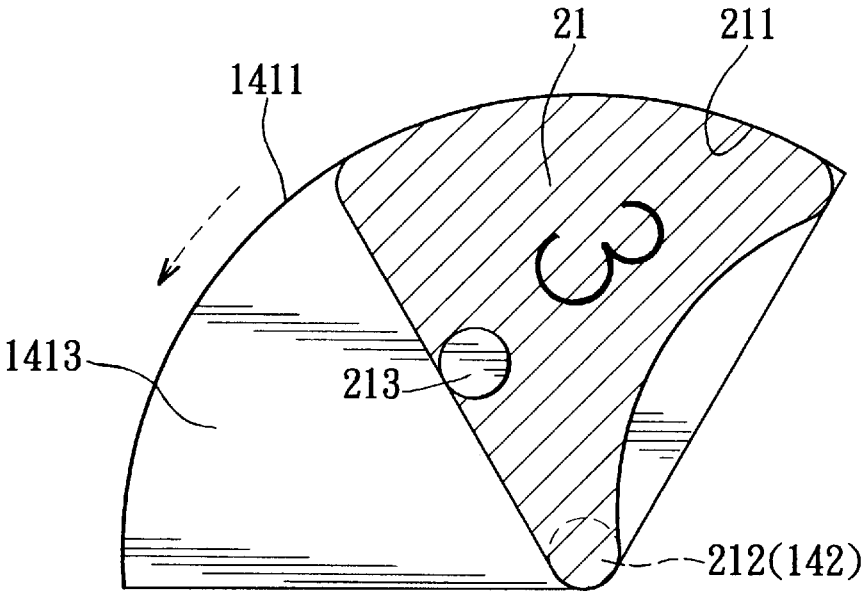
FIGS. 5 and 6 are schematic views showing how the displaying member is turned in a groove.
Figure 6:
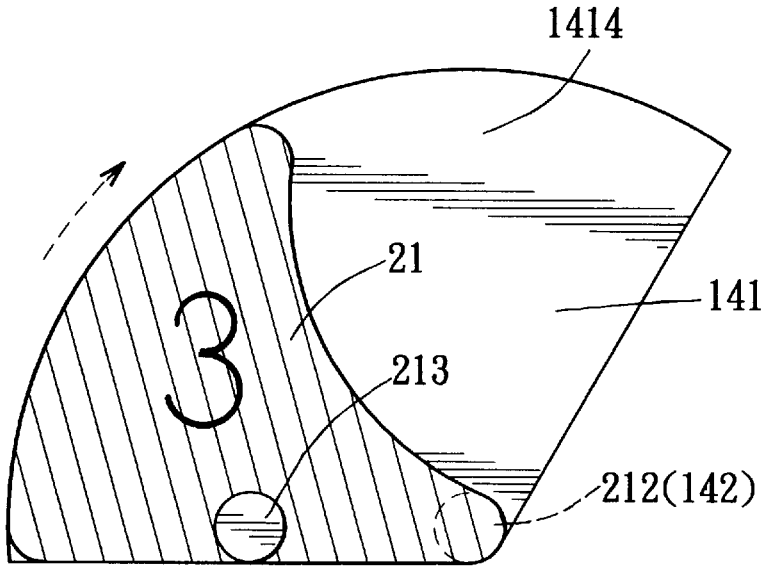
Figure 8:
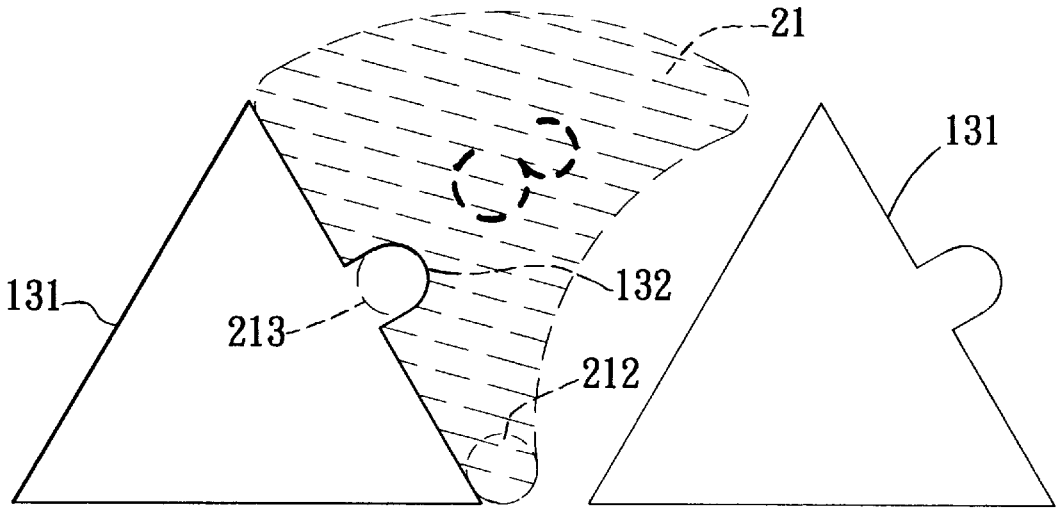
FIGS. 8 and 9 are schematic views showing the relationship between the displaying member and a displaying opening in the upper board.
Figure 9:
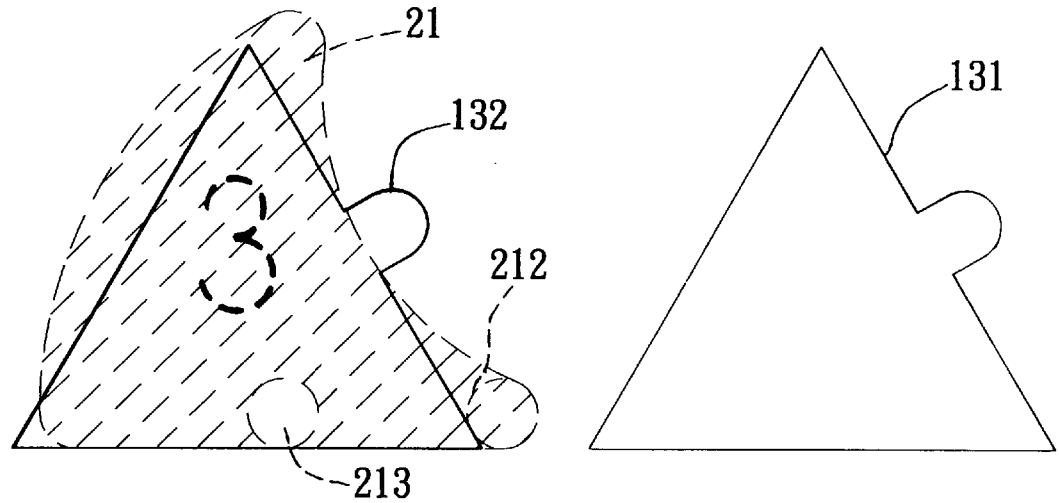

Referring to FIGS. 2, 3 and 4, each displaying member 21 includes an upper major wall 215 with a specific print 215*a*, such as an alphanumeric symbol, thereon. A swivel pin 212 extends downwardly from the upper major wall 215. A tipped stem 213 extends from the upper major wall 215 opposite to the swivel pin 212, and is disposed to be spaced radially apart from the swivel pin 212. Each displaying member 21 is interposed in the groove 141 in such a manner that the swivel pin 212 is inserted detachably and pivotally into the swivel hole 142 so as to define a swivel axis parallel to the transverse direction. As such, the user can grip the tipped stem 213 to turn the displaying member 21 about the swivel axis between a respective leading swept area 1413, as shown in FIGS. 6 and 9, where the specific print 215*a* is exposed to a corresponding displaying opening 131, and a respective tailing swept area 1414, as shown in FIGS. 5 and 8, where the specific print 215*a* is hidden under a corresponding shielded area 133. Moreover, the displaying member 21 has a peripheral minor wall which includes an outer annular surface wall 211 to engage the guiding wall portion 1411, and a concave wall 214 to prevent contact with the adjacent displaying member 21 during in the respective tailing swept area 1414, an abutment wall portion 216 that can abut against the barrier wall portion 1412 when the displaying member is in the leading swept area, and a leading portion 217 that can slide on and is guided by the guiding wall portion 1411 when the displaying member 21 is swept between the leading and tailing swept areas. Referring to FIG. 8, when the displaying member 21 is turned in the respective tailing swept area 133, the swivel pin 213 engages the engaging hole 132 so as to completely hide the displaying member 21 under the respective shielded area 133.

Figure 7:
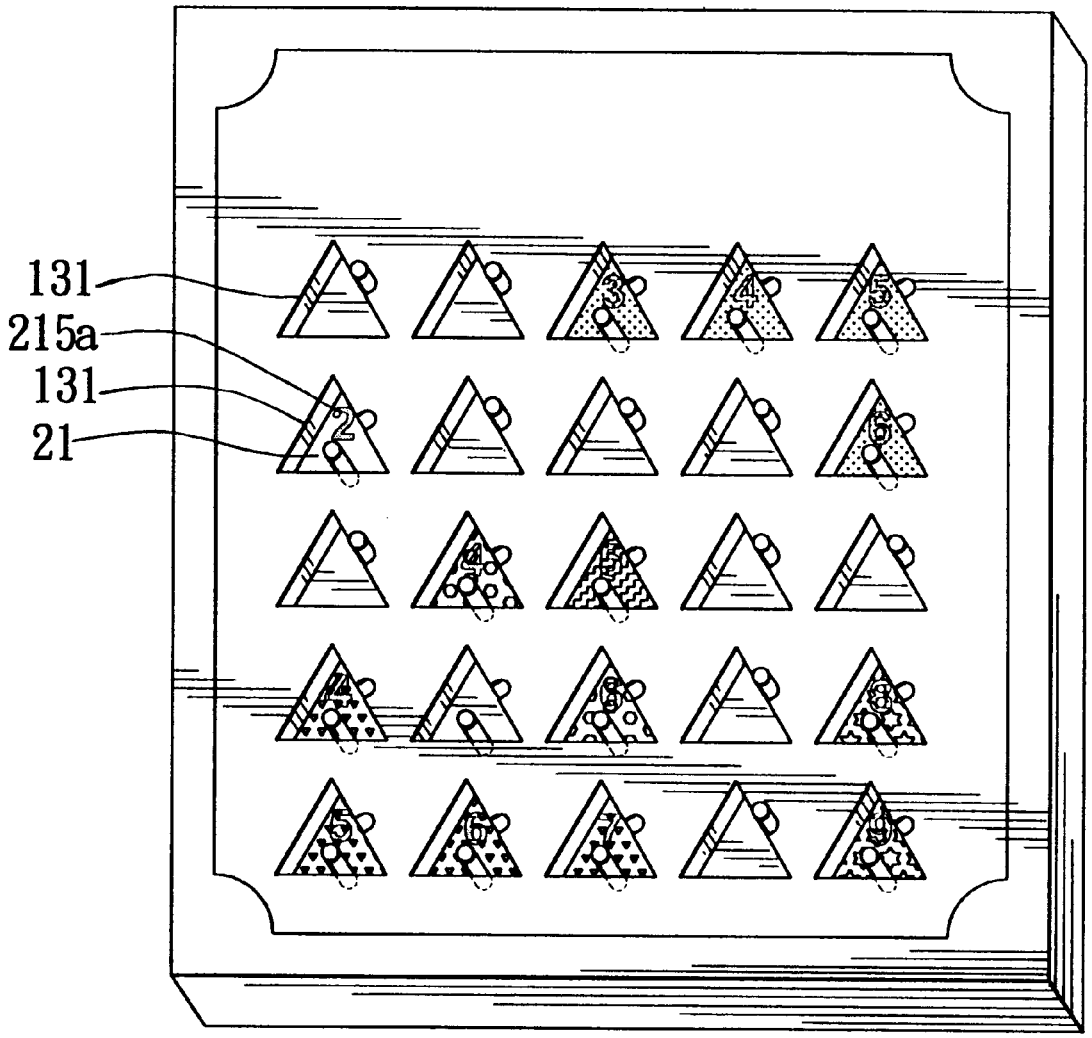
FIG. 7 is a schematic view of the preferred embodiment in use.

Before the start of a game, each participant is given a game device. Thereafter, the displaying members 21 are mounted swiveledly in the grooves 141 respectively, and are turned in the corresponding tailing swept area 1414. A predetermined arrangement is then declared in advance. The caller will randomly draw out a number from a bag and calls out the drawn number. Each participant then searches for a displaying member 21 which is printed with the drawn number, and turns the same to the corresponding leading swept area 1413 to expose the number to the displaying opening 131, as shown in FIG. 7. The first participant to form the required arrangement is declared the winner. It is noted that the upper board 13 may be made of a semi-transparent material. Alternatively, the displaying members 21 may be mounted and turned in the leading swept areas 1413 in advance. Then, each participant searches for a displaying member 21 printed with the number drawn by a caller, and turns the same in the corresponding tailing swept area 1414 for hiding under the respective shielded area 133, thereby forming a column of space. The first participant to form the declared column of space is declared the winner.

As mentioned above, according to this invention, the game device can be used to play a variety of games with different arrangements. In addition, since the displaying members 21 are mounted in the grooves 141 respectively, the game device has a relatively small size, as compared to the conventional game box, and can prevent undesired removal and misplacement of the displaying members 21. Moreover, by the swivel arrangement of the displaying members 21, the game device is convenient to use.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A game device comprising:

an upper board including a plurality of upper rows of first displaying areas which respectively define first displaying openings, each of said upper rows oriented in a longitudinal direction, a plurality of upper rows of first shielded areas each of which is disposed angularly adjacent to a respective one of said first displaying openings, a plurality of upper columns of second displaying areas which respectively define second displaying openings, each of said upper columns oriented in a first transverse direction transverse to the longitudinal direction, and a plurality of upper columns of second shielded areas each of which is disposed to be angularly displaced and adjacent to a respective one of said second displaying openings, wherein each of said first displaying openings and each of said first shielded areas are substantially and respectively identical to each of said second displaying openings and each of said second shielded areas such that said plurality of upper rows and said plurality of upper columns constitute an array of displaying openings and shielded areas;

a lower mounting board disposed to be spaced apart from, and superimposed by said upper board in a second transverse direction transverse to both of the longitudinal direction and the first transverse direction, said lower mounting board defining a plurality of lower rows of first leading swept areas which are registered respectively with said plurality of upper rows of said first displaying openings in the second transverse direction, a plurality of lower rows of said first tailing swept areas each of which is disposed angularly adjacent to a respective one of said first leading swept areas, and each of which is registered with a respective one of said first shielded areas, a plurality of lower columns of second leading swept areas, and a plurality of lower columns of second tailing swept areas each of which is disposed to be angularly displaced and adjacent to a respective one of said second leading swept areas, wherein each of said first leading and first tailing swept areas are substantially and respectively identical to each of said second leading and second tailing swept areas, such that said plurality of lower rows and said plurality of lower columns constitute an array of leading and tailing swept areas, said lower mounting board being formed with a plurality of grooves, each of said grooves extending in the second transverse direction to define a respective one of said leading and tailing swept areas for receiving at least one of said displaying members; and a plurality of displaying members, each including an upper major wall with a specific print thereon, and each being interposed between a respective one of said shielded areas and a respective one of said tailing swept areas, each of said displaying members being disposed detachably and being mounted swiveledly on said lower mounting board and proximate to said respective one of said tailing swept areas, such that said upper major wall is turnable about a swivel axis parallel to the second transverse direction between a respective one of said leading swept areas, where said specific print is exposed to a respective one of said displaying openings, and said tailing swept areas, where said specific print is hidden under said respective one of said shielded areas.

2. The game device as claimed in claim 1, wherein said lower mounting board further defines a plurality of swivel holes each of which is disposed between a respective one of said leading swept areas and a respective one of said tailing swept areas, and each of which extends in the swivel axis, each of said displaying members further including a swivel pin which extends in a direction transverse to said upper major wall and which engages detachably a respective one of said swivel holes so as to define the swivel axis.

3. The game device as claimed in claim 2, wherein each of said displaying members further includes a tipped stem which is disposed to be spaced radially apart from said swivel pin and which extends from said upper major wall opposite to said swivel pin to facilitate turning of said displaying members between said respective one of said leading swept areas and said respective one of said tailing swept areas.

4. The game device as claimed in claim 3, wherein said upper board further has a plurality of engaging holes, each of which is disposed between a respective one of said displaying areas and a respective one of said shielded areas so as to engage said tipped stem when a respective one of said displaying members is in said respective one of said tailing swept areas.

5. The game device as claimed in claim 1, wherein each of said grooves is defined by a barrier wall portion and a guiding wall portion.

6. The game device as claimed in claim 1, wherein each of said grooves is defined by a peripheral wall that includes a barrier wall portion, said barrier wall portions of each of said lower rows being aligned with one another in the longitudinal direction.

7. The game device as claimed in claim 6, wherein each of said displaying members further including a peripheral minor wall surrounding and extending from said upper major wall in the second transverse direction, and including an abutment wall portion which is disposed to abut against said barrier wall portion when a respective one of said displaying members is in a respective one of said leading swept areas and a leading portion which is disposed at a vertex opposite to said abutment wall portion and which leads sweeping movement of the respective one of said displaying members from a respective one of said leading swept areas to a respective one of said tailing swept areas.

8. The game device as claimed in claim 7, wherein each of said peripheral walls of said lower mounting board further includes a guiding wall portion which is spaced apart from said barrier wall portion in the first transverse direction such that said leading portion slides on and is guided by said guiding wall portion when a respective one of said displaying members is swept between said leading and tailing swept areas.

* * * * *